US005279502A

United States Patent [19]

Goughnour

[11] Patent Number: 5,279,502

[45] Date of Patent: Jan. 18, 1994

[54] APPARATUS AND METHOD FOR CONSTRUCTING COMPACTED GRANULAR OR STONE COLUMNS IN SOIL MASSES

[75] Inventor: R. Robert Goughnour, Leesburg, Va.

[73] Assignee: Geotechnics America, Inc., Peachtree City, Ga.

[21] Appl. No.: 781,849

[22] Filed: Oct. 24, 1991

[51] Int. Cl.[5] ..... E02D 5/46

[52] U.S. Cl. ..... 405/237; 405/233; 405/240; 405/248

[58] Field of Search ..... 405/232, 233, 236–238, 405/240, 248, 253, 254

[56] References Cited

U.S. PATENT DOCUMENTS

| | | | |
|---|---|---|---|
| 2,122,584 | 7/1938 | Peck | 405/238 X |
| 3,255,592 | 6/1966 | Moor | 405/237 X |
| 3,438,212 | 4/1969 | Turzillo | 405/237 X |
| 3,707,848 | 1/1973 | Chelminski . | |
| 3,808,823 | 5/1974 | Chelminski | 405/240 X |
| 4,126,007 | 11/1978 | Mars | 405/271 |
| 4,433,943 | 2/1984 | Pao Chen | 405/241 |
| 4,496,011 | 1/1985 | Mazo et al. | 405/240 X |
| 4,601,613 | 7/1986 | Wolf | 405/240 X |
| 4,637,758 | 1/1987 | Tamaki et al. | 405/248 |
| 4,730,954 | 3/1988 | Sliwinski et al. | 405/240 |

FOREIGN PATENT DOCUMENTS

| | | | |
|---|---|---|---|
| 3501439A1 | 10/1985 | Fed. Rep. of Germany . | |
| 293860A5 | 9/1991 | Fed. Rep. of Germany . | |
| 1177711 | 4/1959 | France | 405/253 |
| 2215075 | 8/1974 | France . | |
| 2513304 | 3/1983 | France . | |
| 55-49421(A) | 4/1980 | Japan . | |
| 56-135622(A) | 10/1981 | Japan . | |
| 59-413 | 1/1984 | Japan . | |
| 40419 | 3/1985 | Japan | 405/240 |
| 296011 | 12/1987 | Japan | 405/253 |
| 8402591 | 3/1986 | Netherlands | 405/237 |
| 47737 | 3/1930 | Norway | 405/253 |
| 146798 | 7/1931 | Switzerland | 405/237 |

*Primary Examiner*—Randolph A. Reese
*Assistant Examiner*—John Ricci
*Attorney, Agent, or Firm*—Carothers & Carothers

[57] ABSTRACT

Compacted granular or stone columns are constructed in soil to increase the load-bearing capacities of the native soil. An elongated hollow tubular member is penetrated down into the soil to a predetermined depth and then the granular material or stone for constructing the column is fed down through this member and out the lower end thereof where it is then driven outwardly in a radial direction by an impeller which is exposed, at least in part, at the lower end of the tubular member, as the hollow tubular member is either penetrating or being withdrawn from the soil at a predetermined rate to thereby forceably compact this granular or stone material in a substantially radial direction to construct a stone column. Sufficient forces may be applied by the impeller to the granular or stone material to fracture the surrounding soil.

25 Claims, 3 Drawing Sheets

APPARATUS AND METHOD FOR CONSTRUCTING COMPACTED GRANULAR OR STONE COLUMNS IN SOIL MASSES

BACKGROUND OF THE INVENTION

The invention generally relates to the upgrading of soft or weak soil areas having low shear or bearing strength, such as alluvial soil or hydraulic fill areas. More particularly, the present invention relates to improvements relating to the treatment of soil masses for building foundations and like structures through the construction of compacted granular or stone columns in situ or in soil masses.

Stone columns, as the name implies, are simply vertical columns of compacted crushed stone, gravel or sand which extend through a deposit of soft material or soil to be strengthened. Normally a number of these densely compacted granular material columns are produced beneath the site for the intended construction project. These columns serve to stabilize the soil, resulting in considerable vertical load capacity and improved shear resistance in the soil mass.

Stone column applications have included soil stabilization to limit settlement under reinforced earth walls, tank farms, dam and highway embankments, bridge abutments, and buildings. Another application is the stabilization and prevention of landslides. Stone columns also function as efficient gravel drains in providing a path for relief of excess pore water pressures, thus preventing linquefaction during an earthquake.

There are a number of well known methods for the formation of stone columns in the ground. One such common method is the use of a special vibrator, sometimes known as a Vibroflot, which expels water from its body as it sinks into the ground, thus forming a hole. The hole, held open by water pressure, is then filled with stone and the stone is compacted into the ground in stages using the vibrator. A stone column is thus formed in the ground which serves to strengthen the soil and also provides a draining path which is beneficial to the rapid consolidation of the ground as structural loads are subsequently applied. An example of this method is described in U.S. Pat. No. 4,397,588 for METHOD OF CONSTRUCTING A COMPACTED GRANULAR OR STONE COLUMN IN SOIL MASSES AND APPARATUS THEREFORE.

Utilization of this method produces very large quantities of silt laden effluent which must be disposed of. Disposal of this effluent is difficult and expensive under the best of conditions, and virtually prohibitive at environmentally sensitive locations. Consequently, most column installation with Vibroflots now makes use of ancillary bottom-feed equipment which provides a feed pipe to the tip of the Vibroflot. Stone with compressed air is fed through this pipe to the tip of the vibrator, thus eliminating the need for water. Although production by this method is much slower, savings in effluent disposal usually more than offset the additional cost.

Other known methods for the formation of stone columns utilize an elongated hollow tube or pipe which is penetrated into the ground, usually with the aid of vibration. Crushed stone or other granular material is then charged into the tube and as this particulate material is fed to the bottom of the tube and discharged the discharged and particulate material is compacted through the application of vertically applied forces either by repeatedly raising and lowering the pipe as it is withdrawn from the ground or by a reciprocating compactor mounted in the tube.

Examples of these methods for producing stone columns are illustrated in the following U.S. Pat. Nos. 3,648,467; 3,720,063; 3,772,892; 3,808,822; 4,126,007; 4,487,524; and 4,730,954.

Most of these prior art methods make use of an equipment withdrawal and repenetration sequence. That is, particulate material is deposited in the bore as the probe is withdrawn. This freshly placed material is then compacted and forced outward into the native soil by repenetration of the probe. A disadvantage of this sequence is that large amounts of soft native soil are dragged down with the probe into the column, resulting in considerable contamination and mixing of the native soil into the column. Such contamination and mixing tends to weaken the column as well as to lower its permeability.

Another problem with all of the above-identified prior art methods is that it is difficult to provide adequate quality control techniques in stone column construction.

A good quality stone column is one which performs efficiently at a given replacement ratio and it is generally agreed that such a column must be constructed of material which has a large angle of internal friction. This material should be tightly compressed into, and thus supported by, the in situ soil. Present practice is to assume that motor power consumption achieved during column repenetration provides a measure of this confinement. However, earth reaction forces significantly affect the behavior of the equipment which is utilized to install the stone column and thus motor power consumption cannot completely specify conditions. This is true not only with regard to the first above-mentioned technique utilizing a laterally vibrating probe, but this is also true with the use of the techniques which utilize an elongated vertical tube, as the forces utilized to downwardly expel the granular material from the bottom of the hollow tube does not provide a measurement of the degree of lateral compression of the granular material within the column being constructed.

This is so because the techniques employed to expel the granular material from the bottom end of the hollow tubular structures function to force the granular material downwardly out of the bottom end of the tube and therefore to date no adequate method has been provided for adequately forcing the granular material outward in a radial direction away from the bottom of the tube and in addition to provide a means for adequately measuring the applied forces required to accomplish this radial compaction of the granular material.

In actuality, there is no relationship between the computed centrifugal force that the Vibroflot provides, or the outward radial forces that the computed downward expulsion force of particulate material that the elongated tubular member provides during repenetration, and the amount of force with which the stones or granular material is forced or propelled into the in situ soil during stone column installation. In reality, these forces for creating the particulate or stone columns of the prior art methods and structures bear very little relationship to the actual force which exists between the apparatus and the soil within which the stone column is being constructed.

Accordingly, a measurement of motor power consumption which energizes the apparatus of the prior art for applying these compaction forces does not provide any adequate measure of the applied forces radially imposed on the in situ soil and the particulate material utilized to construct the particulate or stone column. In addition, because prior art devices apply outward forces due only to internal shear occurring in the column when driving the probe into the stone during repenetration, sufficient radial compaction forces cannot be provided and adequately controlled for different given in situ soil conditions in order to provide predetermined radial displacement of the column.

In addition, because of the way compaction forces are applied, all of the above-identified methods for installing granular or stone columns have a relatively slow production rate. For example, with the best of the above-identified bottom feed methods, one can normally install 300 to 350 feet of stone column per day for a single rig adapted for installing the columns in very soft soil. Perhaps even at ideal rates and conditions, a rate of 400 feet per day might be obtainable. However, it is a principal object of the present invention to provide an apparatus and method that will at least double this production rate for the same column construction such that possibly 1,000 feet of column may be produced by one rig per day in the same given period of production time.

It is also a principal object of the present invention to eliminate the disadvantages of the above-mentioned prior art apparatus and methods for constructing stone columns in situ and to produce such columns at a reduced cost with improved effectiveness and with improved quality control over construction. It is a further object and advantage of the present invention to provide an apparatus and method for constructing such granular or stone columns in situ under such conditions which eliminate intermixing and contamination of the column with native soil, and which can force the sand or stone radially outward in a precisely controlled and regulated manner such that the measurement of this force is in direct relationship to the actual force which exists between the equipment installing the stone or granular column and the soil. Such conditions are ideal to produce soil fracturing or vertical cracks which provide drainage channels to reduce time for reconsolidation with additional soil improvement during and after installation (K. R. Massarch, "New Aspects of Soil Fracturing in Clay," Jour. of the Geot. Engr. Div., ASCE, Vol. 104, No. GT8, August, 1978).

SUMMARY OF THE INVENTION

The apparatus of the present invention for forming columns of compacted granular or stone material in soil to increase the load bearing capabilities thereof generally comprises an elongated hollow tubular member having upper and lower ends and a hopper or other feed mechanism connected to this member at or near the upper end thereof for supplying or charging this granular material thereto.

An impeller is secured to the lower end of this hollow tubular member and this impeller, or at least a portion thereof, is exposed below the lower end of the hollow tubular member. The impeller is utilized to outwardly and radially force or expel and compact the granular material as it exits the lower end of the hollow tubular member while the lower end thereof may be either vertically lowered or raised in the soft soil to thereby construct a stone column.

This method of stone column installation may build the stone columns on both the penetration and withdrawal cycles.

It is well known that clays and clay-silts have very low permeabilities and require very long periods for consolidation. Thus, the hope of producing any appreciable improvement in the in situ soil by entrapping stresses or through consolidation during stone column installation is remote. With the method and apparatus of the present invention the stone column can be rather quickly constructed and expanded radially without contamination or intermixing to create not only a well compacted column but in many cases to produce soil fracturing so that the pore water is permitted to escape from the soil through the stone column.

The method and apparatus of the present invention also permits one to readily control and monitor the amount of force with which the impeller forces or propels the stone into the in situ soil during stone column installation by monitoring motor torque required to drive the impeller, since the torque does bear a relationship to the amount of force with which the impeller forces or propels the stones into the in situ soil, which is not the situation with all of the above described prior art devices and systems. None of the prior art methods, systems or devices which utilize an elongated tube, provide actual direct radial expulsion or propulsion forces for driving the stone or granular material into the surrounding in situ soil during column installation. This feature of the present invention also permits uncontaminated columns to be installed at a much faster rate than was heretofore possible with improved column effectiveness and improved quality control and even as the further possibility of soil fracturing which is not possible with the prior art methods.

The impeller in one form is rotatable about a vertical axis at the bottom of the elongated hollow tubular member for radially expelling the material into the in situ soil. This rotary impeller is preferably provided with at least two outwardly exposed spiral impeller faces for driving and compacting the material outwardly. The sand or stone is forced radially outward by the spiral portion of the impeller. This occurs because the coefficient of friction of the sand or stone against the impeller is less than the coefficient of friction against the surrounding material. The resultant stress against the impeller is oriented with respect to the impeller surface at an angle equal to the angle of friction between the impeller and the stone. This angle remains fairly constant. A log spiral shape has the property that when the resultant stress against the spiral is oriented at a constant angle with respect to the log spiral surface, this direction is constant with respect to the log spiral origin which is chosen to correspond to the axis of rotation.

In order to assist in charging the granular material downwardly through the elongated hollow tubular member and into the impeller at the bottom, it has been found advantageous to introduce air under pressure into the upper end of the elongated hollow tubular member. Generally the air pressure supply within the member is maintained at a pressure of approximately 15 to 50 p.s.i.

In order to assist penetration of the elongated hollow tubular member downwardly into the soil to be treated, a vibratory pile driver is mounted near the upper end of the member for driving the member downwardly by applying vertical vibrations to the member. The same vibrations may also be utilized for purposes other than penetration and maybe also helpful to assist in a withdrawal and in compacting the column being constructed. The crane or vehicle carrying the tubular member can also be employed to apply downward soil penetrating forces.

Additionally, the impeller at the bottom of the elongated tubular member may be driven by a motor which is mounted at the top of the member and which has an elongated vertical drive shaft coaxially positioned in the member and this long hollow drive shaft may also be hollow for conveying fluids therethrough to or from below the impeller. This shaft tubular passage may be utilized to evacuate water from the bottom of the elongated member as the column is being constructed or in fact may be utilized to force water downwardly therethrough under pressure to help penetration of the apparatus, or in fact it may be also used to introduce grout under pressure into the stone column being constructed in order to provide a grouted stone column, or may be used to introduce other stabilizing chemicals into the column or surrounding soil.

A nose cone may also be secured to the underside of the impeller for assisting in downward penetration of the member in soil and to also assist in driving the stone or granular material outward. The cone may have either a smooth conical surface or the like or it may be provided with an inverted conical spiral surface for assisting in outward explusion of the material exiting from the lower end of hollow tubular member.

Instead of mounting the motor which drives the impeller at the top of the elongated hollow tubular member, one may also provide the motor at the bottom thereof and in this instance the motor could still be driven either electrically or hydraulically.

BRIEF DESCRIPTION OF THE DRAWINGS

Other objects and advantages appear in the following description and claims.

The accompanying drawings show, for the purpose of exemplification, without limiting the invention or the claims thereto, certain practical embodiments illustrating the principals of this invention, wherein:

DETAILED DESCRIPTION OF A PREFERRED EMBODIMENT

Figure 1:
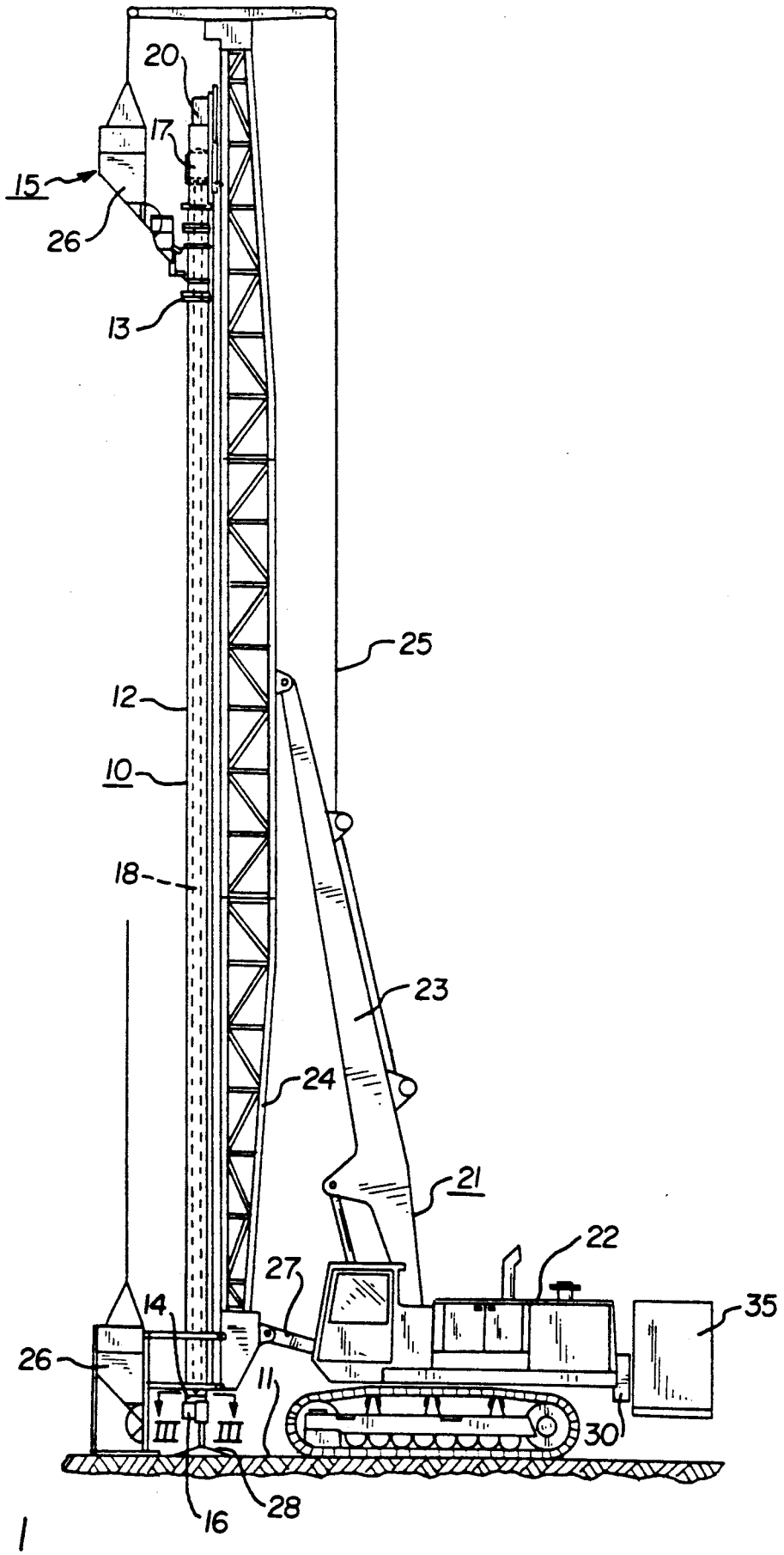
FIG. 1 is a diagramatic view in side elevation illustrating the apparatus of the present invention for forming a column of compacted granular or stone material in soil as being carried by a crane.

The apparatus 10 of the present invention for forming a column of compacted granular or stone material in soil 11, in order to increase load bearing compacities thereof, generally is comprised of an elongated hollow tubular member 12 which has upper and lower ends 13 and 14 respectively. A feed mechanism 15 is provided near or connected to the member 12 at or near the upper end 13 thereof for supplying or charging the stone or granular material into the top of hollow tubular member 12.

An impeller 16 is provided or secured to the lower end 14 of tubular member 12 and the impeller is exposed below the lower end 14 and is operable for outwardly expelling granular material as it exits the lower end 14 of tubular member 12 in a substantially radial direction.

Impeller 16 is rotatably secured to the lower end 14 of tubular member 12 and is rotatably driven by rotary motor 17 which rotatably drives impeller 16 by means of shaft 18 which is concentrically mounted within tubular member 12.

Member 12 is also provided with a vibrator 20 at the upper end thereof to assist in driving the member downwardly into soil 11 thereunder and to also assist in compacting stone fed to the column under construction and to further assist in feeding the stone downwardly through member 12.

The member 12 is carried by a crane 21 which includes an excavator 22, a boom 23, a mast 24, and a cable 25 for raising and lowering hopper 26 of the feed mechanism 15. In the Figure, hopper 26 is illustrated both in its fully upward position for feeding granular material into member 12 and also at its fully downward position for loading.

Spotter arms 27 are also provided on the front end of excavator 22 in order to assist in positioning the adjustable stabilization feet 28 on ground 11.

Counterweight 30 is provided on the back of excavator 22 in order to counterbalance the mast and its load in the form of tubular member 12 which is carried for vertical movement up and down mast 24.

Figure 2:
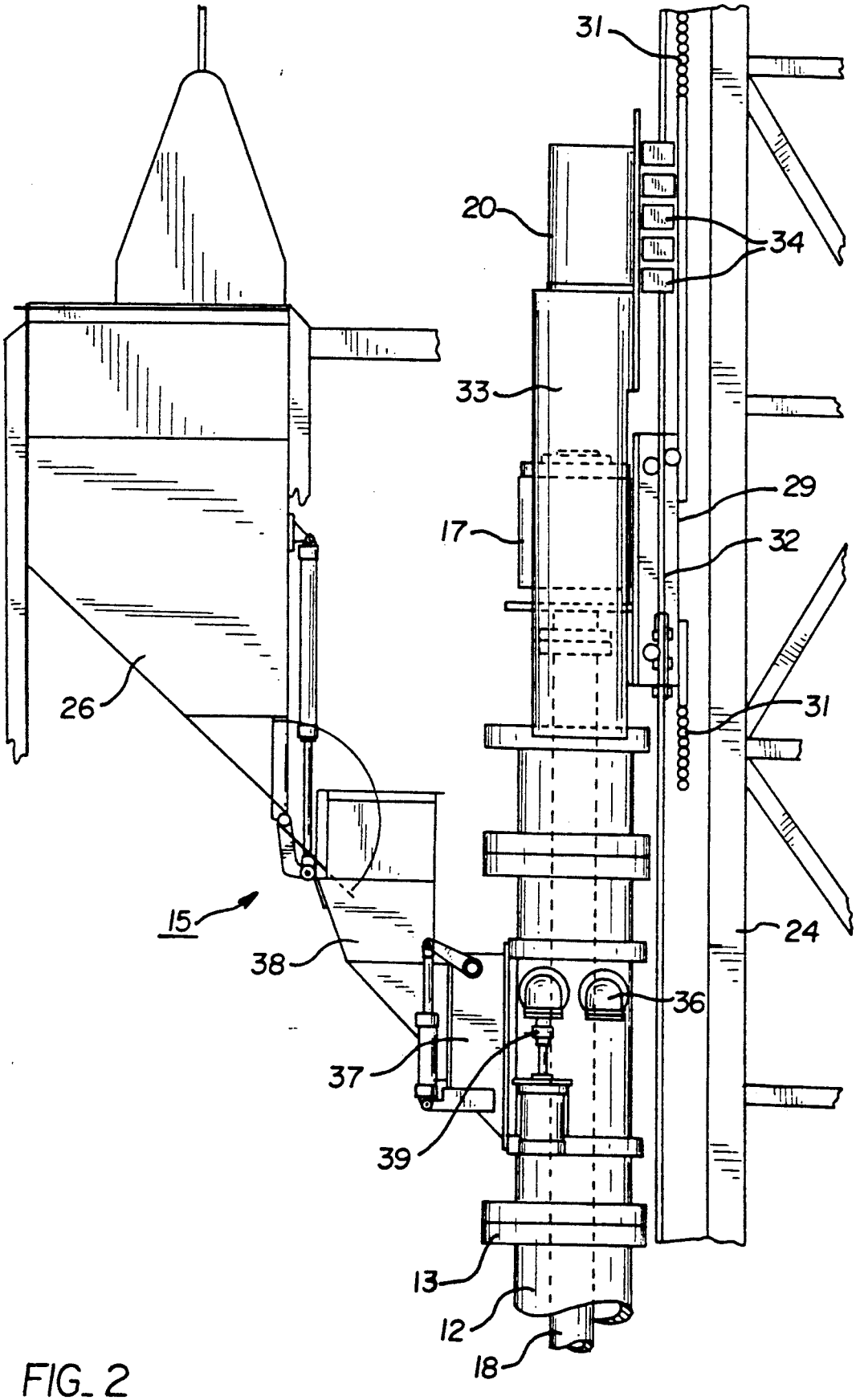
FIG. 2 is a diagramatic view in side elevation illustrating the upper portion of the apparatus and mast shown in FIG. 1.

Additional reference is now also made to FIG. 2 for describing the overall operation of the mechanism for carrying out the method of the present invention.

The elongated tubular member 18 is carried for vertical movement on mast 24 by means of drive chain 31 which carrys hollow tubular member 12 up and down track 32 on car 29.

Through the use of drive chain 31, which is driven from excavator 22, downward penetrating forces of up to ten tons can be applied to tubular member 12 to assist in penetrating the apparatus downwardly into the soil 11 thereunder to be treated. This downward penetration is of course also assisted by vibrator 20 which transmits vibrations to tubular member 12 by means of frame 33. The vibrations of vibrator 20 are isolated from drive chain 31 through the use of vibration isolation blocks or pads 34.

In operation, the entire apparatus is moved by excavator 22 to the desired location and the spotter arm 27 and boom 23 are positioned to properly position the impeller 16 over the proper location of underlying earth 11 and adjustable stabilization feet are then hydraulically set.

All of the mechanisms are hydraulically operated through the use of a hydraulic power pack in housing 35 mounted on the rear of excavator 22. An air compressor is also packaged in unit 35 for providing air under pressure to the interior of tubular member 12. The flexible hoses utilized for connecting the air under pressure and hydraulic fluid under pressure to the various mechanisms on apparatus 10 are not shown in the drawings in order to reduce the possibility of any confusion in the figures.

Once the appropriate site has been selected, the tubular member 12 is then driven vertically downward under forces applied by drive chain 31, the drive mechanism is operated by the operator of excavator 22. The operator has control of all mechanisms for controlling the apparatus 10.

As the tubular member 12 is driven downwardly by drive chain 31, vertical vibrations are also applied by vibrator 20 to tubular member 12 to assist in the downward penetration of the member 12 into the underlying soil.

If desired, the construction of the stone column can be started during the downward penetration of the tubular member 12, as well as during the withdrawal period or cycle of the tubular member 12. During the soil penetration, impeller 16 may also be rotated to assist in penetration and/or to radially drive stone outwardly from the bottom 14 of member 12 to initiate construction of a stone column.

As previously explained, motor 17 rotatably drives impeller 16 by means of rotary shaft 18. A typical rate of rotation might be 60 to 70 rpm, however the speed of motor 17 is variable over a wide range. Elongated shaft 18 is hollow or tubular throughout its entire length and it may extend downwardly through impeller 16, which it drives, such that the hollow interior of the shaft exits underneath impeller 16.

Accordingly, fluids under pressure may be supplied to the upper end of the hollow interior of shaft 18 for delivery to the underside of impeller 16. For example, water under pressure may be supplied through tubular drive shaft 18 to assist in penetrating the member 12 downwardly into the soil. In a similar manner, one may supply a cementatious grout through shaft 18 in order to provide a grouted stone column. Stabilizing chemicals may also be supplied through shaft 18.

The hollow drive shaft 18 may also be utilized to evacuate unwanted water from the stone column being constructed.

In order to carry out the method of the present invention for constructing compacted granular or stone columns in the soil 11, the hopper 26 is first lowered by crane 21 to ground level as indicated at the bottom of FIG. 1 and the hopper is there charged with stone or other granular material which will make up the column.

The filled hopper 26 is then raised by cable 25 from crane 21 to its upper discharge position which is also shown in FIG. 1 at the top. The detail of this upper discharge position is better illustrated in FIG. 2.

When one is ready to discharge the contents of hopper 26 into the upper hollow end 13 of elongated tubular member 12, one must first release the air pressure within tubular member 12 so that the airlock may be released to permit access of the granular material into the hollow interior of member 12.

As previously explained, air under pressure is supplied to the hollow interior of the elongated pipe member 12 and this is accomplished by feeding air under pressure through an elongated flexible hose (not shown) which runs from an air compressor housed in unit 35 at the rear of excavator 22 to the inlet 36 which accesses the air under pressure into the interior of tubular member 12.

An airlock 37 provides an airlock between airlock chute 38 and the interior of member 12. This airlock 37 cannot be readily released until the air pressure in the interior of tubular member 12 is reduced. For this purpose air release mechanism 39 is provided so that the operator may first release air pressure within tubular member 12 and thereafter open airlock 37 and then dump hopper 26 to discharge the contents thereof into airlock chute 38 and on into the interior of elongated member 12 through the airlock 37.

After the stone has been charged into elongated tubular member 12, the operator may then once again close the bottom chute opening of hopper 26, engage airlock 37, disengage air release mechanism 39 and then reintroduce air under pressure into the interior of member 12 through inlet 36.

As previously explained, the elongated tubular member 12 may be charged with stone during the downward penetration stroke of the member 12 into the underlying earth 11 or it may also or only be charged with stone or granular material during the withdrawal stroke of the elongated tubular member 12.

Figure 3:
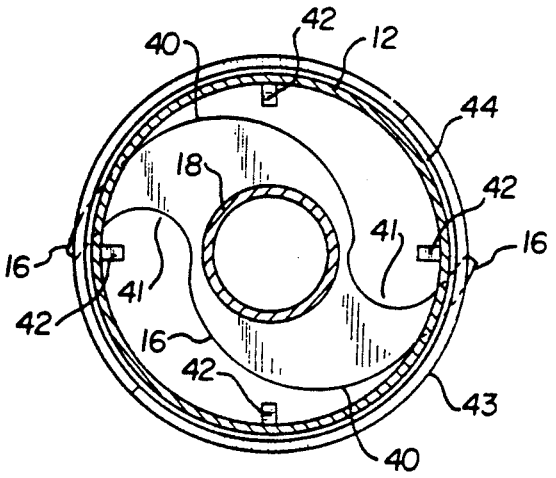
FIG. 3 is a sectional view of the lower end of the apparatus of the present invention of FIG. 1 as seen along section line III-III which illustrates the detail of the impeller at the bottom of the apparatus.
Figure 4:
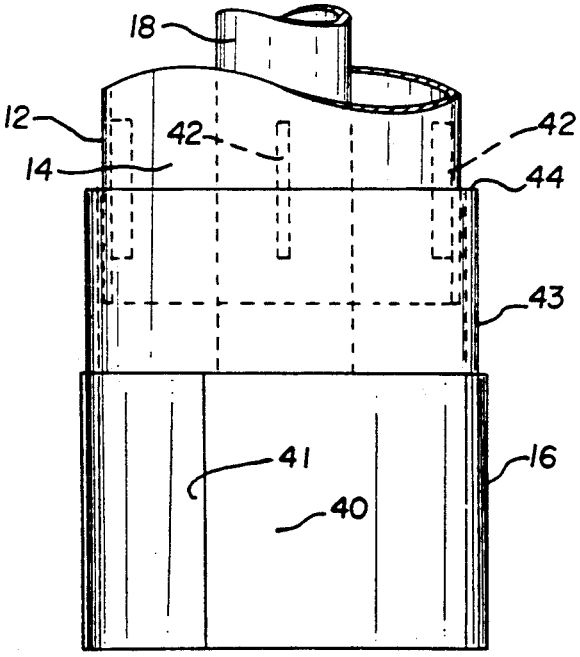
FIG. 4 is a view in side elevation of the structure shown in FIG. 3.

In either event, the stone column is formed by continually energizing rotary motor 17 which continually rotates impeller 16 at the bottom end of member 12 via vertical drive shaft 18. Rotary impeller 16 is exposed at the bottom of elongated tubular member 12 and is designed to radially force the granular material exiting the bottom end 14 of elongated tubular member 12 outward by compacting the granular material or stone into itself and radially outward into the in situ soil. Detail construction of impeller 16 is illustrated in FIGS. 3 and 4.

Impeller 16 is rigidly secured to the bottom end of shaft 18 so that it rotates with shaft 18. As seen in FIG. 3, impeller 16 is rotated in a clockwise direction.

Impeller 16 is provided with two symmetrically opposed impeller blades having outwardly exposed spiral impeller faces 40 which force the stone or granular material radially outward with respect to vertical as the material exits lower end 14 and enters into the cavities formed at the back portions 41 of the impeller blades.

In order to assist in preventing the impeller blade from twisting the column of granular material or stone still in tubular member 12 and being fed downwardly through tubular member 12, guide vanes 42 are provided at the lower end 14 of tubular member 12.

In order to properly rotatably support impeller 16 at the bottom end of tubular member 12, the upper surfaces of impeller 16 are welded to outside bearing pipe or tube 43 and bearing pipe 43 is permitted to rotate on the lower end 14 of member 12. For this purpose a mere slip bearing or another suitable bearing 44 may be provided between the bearing pipe 43 and the lower end 14 of member 12.

Figure 5:
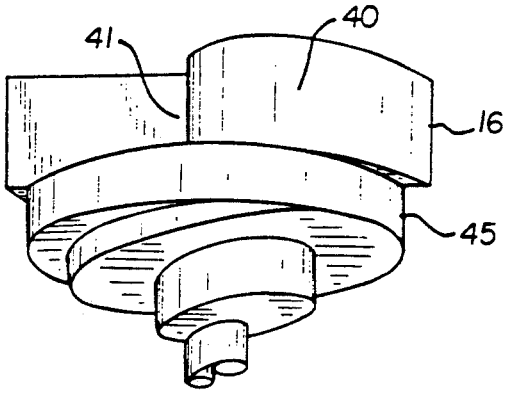
FIG. 5 is a perspective view of the impeller portion of the apparatus illustrated in FIGS. 3 and 4 with a spiral cone attached to the underside thereof.

Referring now to FIG. 5, the impeller 16 may also be provided on the underside thereof with a cone 45 for assisting downward penetration of the tubular member 12 in harder ground.

In FIG. 5, the cone 45 is illustrated as having a spiral surface that will assist not only in downward penetration but will further assist in outwardly driving and compacting the granular material for assisting in constructing a stone column.

The cone 45 could also be nothing more than a smooth cone and it could be smaller in diameter than illustrated. Also, one should realize that cone 45 would be used only in specific soil conditions and the cone is not always desirable in most soil conditions, as higher quality stone columns can be constructed without the use of the additional cone.

Figure 6:
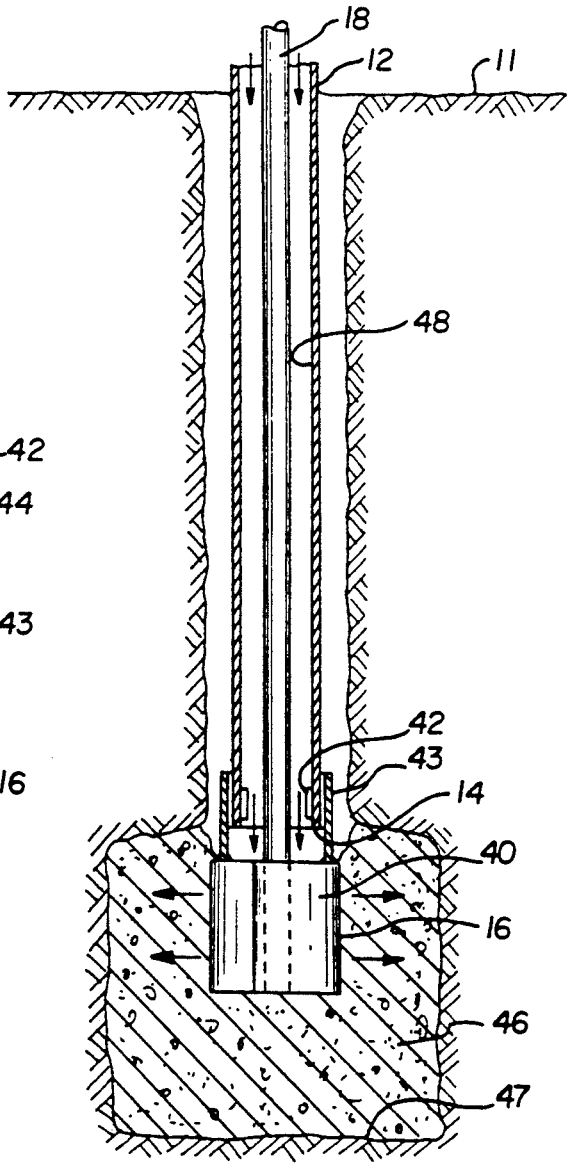
FIG. 6 is a diagramatic view in partial vertical section illustrating the apparatus of the present invention constructing a stone column in the ground.

In order to provide a clear understanding of how a stone column is constructed by the method and through the use of the apparatus of the present invention, reference is made to FIG. 6.

FIG. 6 illustrates construction of a stone column 46 in soil 11. The tubular member 12 is being withdrawn upwardly in a vertical direction from the soil 11 at a predetermined rate. In otherwords, this figure illustrates the situation wherein the elongated member 12 together with its impeller 16 mounted at the bottom end thereof has already been driven downwardly into the soil 11 to a predetermined lower limit 47. The stone column is being constructed as the apparatus is being raised and stone is continually being fed downward through the hollow interior 48 of member 12 as indicated by the arrows. In addition to the application of air under pressure as previously described, this operation may further be assisted by the use of vibrations applied by vibrator 20 to member 12.

As the tubular member 12 is being withdrawn upwardly the granular material and stone is being fed downwardly and out through the lower end 14 of member 12 into rotating impeller 16 which forces the granular material or stone outward in a generally radial direction as indicated by the arrows away from the impeller faces 40. This all of course occurs as the elongated number 12 is withdrawn upwardly at a predetermined rate.

Due to the apparatus and method of the present invention it can be thus seen that it is relatively easy to control the quality and size of the stone column 46 being constructed by regulating the feed rate of granular material downwardly through member 12, regulating the revolutions per minute of impeller 16 while regulating the withdrawal rate of member 12, regulating the air pressure supplied to the interior 48 of member 12, and all of these conditions can be monitored in part by monitoring the motor torque required to drive impeller 16. Additionally, the outward or radial forces applied by impeller 16 as indicated by the arrows, can be made strong enough to fracture the surrounding in situ soil if desired.

I claim:

1. Apparatus for forming a column of compacted granular or stone material in soil to increase load-bearing capacities and/or to provide drainage, which comprises: an elongated hollow tubular member having upper and lower ends, feed means connected to said member at or near the upper end thereof for supplying the material thereto, impeller means secured to said lower end and at least a portion of said impeller means exposed below said lower end and operable for continuously and outwardly driving and compacting the material as it exits said lower end in a direction substantially radial of said elongated member, drive means connected to said impeller means for mechanically driving the material with sustained and continuous force, and means for lowering and raising said member in soil.

2. The apparatus of claim 1 wherein said impeller means is rotatably secured to said lower end.

3. The apparatus of claim 2 wherein said impeller means is rotatable about a vertical axis of said elongated member for radially driving and compacting the material therefrom.

4. The apparatus of claim 3 including air pressure means connected to said member near the upper end thereof for supplying air under pressure inside said member.

5. The apparatus of claim 4 wherein said air pressure means supplies air under pressure inside said member at a pressure of approximately 15 to 50 p.s.i.

6. The apparatus of claim 3 wherein said impeller means includes an impeller having at least two outwardly exposed spiral impeller faces for driving and compacting the material outwardly.

7. The apparatus of claim 3 wherein said rotary drive means includes an elongated vertical drive shaft positioned in said member, said drive shaft being hollow throughout for conveying fluids therethrough to or from below said impeller means.

8. The apparatus of claim 3 including a nose cone secured to the underside of said impeller means for assisting in downward penetration of said member in soil.

9. The apparatus of claim 8 wherein said nose cone rotates with said impeller means and has an inverted conical spiral surface for assisting in outward expulsion of the material exiting said lower end.

10. The apparatus of claim 1 including pile driver means mounted near the upper end of said member for driving the member downwardly into underlying soil.

11. The apparatus of claim 1 including vibratory means mounted near the upper end of said member for applying vertical vibrations to said member.

12. A method of constructing a column of compacted granular or stone material in soil to increase load-bearing capacities and/or to provide drainage, comprising the steps of: positioning an elongated hollow tubular member into the soil to a predetermined depth, feeding the material down through the member and out the lower end thereof, mechanically driving the material exiting the lower end of said elongated tubular member with sustained and continuous force for outwardly driving and compacting the material exiting from the lower end of said member in a substantially radial direction with respect to said elongated member.

13. The method of claim 12 including the step of penetrating or withdrawing said member in soil at a predetermined rate while said impeller is driving and compacting the material.

14. The method of claim 13 wherein said impeller is rotary driven.

15. The method of claim 13 including the step of introducing air under pressure into said member adjacent the upper end thereof.

16. The method of claim 15 wherein said pressure is regulated to be in the approximate range of 15 to 50 p.s.i.

17. The method of claim 13 wherein the step of positioning includes the step of driving said member downwardly into the soil.

18. The method of claim 17 wherein the step of downwardly driving said member includes the step of applying vertical vibrations to said member.

19. The method of claim 17 including the step of injecting water under pressure under said member while driving said member downwardly for assisting soil penetration.

20. The method of claim 13 wherein forces applied by said impeller to the material for driving it outward from said impeller for compaction are of sufficient magnitude for fracturing surrounding soil.

21. The method of claim 13 including the step of injecting grout or other chemicals into the compacted material forming the column.

22. The method of claim 13 including the step of extracting excess water from the expelled material during the step of withdrawing said member.

23. The method of claim 13 wherein said impeller is rotated about a vertical axis.

24. The method of claim 23 wherein said impeller is provided with two outwardly exposed spiral impeller faces for implementing the step of outwardly driving and compacting the material.

25. The method of claim 13 including the step of vibrating said member while withdrawing it.

* * * * *